United States Patent [19]

Orton

[11] 4,026,442

[45] May 31, 1977

[54] HOUSEHOLD LIQUID DISPENSER

[76] Inventor: Horace L. Orton, c/o Gina M. Orton, 951 E. 228th St., Bronx, N.Y. 10466

[22] Filed: Dec. 15, 1975

[21] Appl. No.: 640,836

[52] U.S. Cl. ..... 222/181; 222/559

[51] Int. Cl.[2] ..... B67D 3/00

[58] Field of Search ..... 222/181, 514, 518, 522, 222/531, 559, 561, 336; 251/325

[56] References Cited

UNITED STATES PATENTS

| | | | |
|---|---|---|---|
| 1,187,474 | 6/1916 | Hollingsworth | 222/181 |
| 2,681,169 | 6/1954 | Watson | 222/181 X |
| 3,164,302 | 1/1965 | Indjian | 222/181 |

*Primary Examiner*—Stanley H. Tollberg
*Assistant Examiner*—Norman L. Stack, Jr.
*Attorney, Agent, or Firm*—Richard L. Miller

[57] ABSTRACT

A container mountable on a vertical wall surface, the container being made to store and dispense liquids such as detergents; the container having a dispensing outlet valve at its bottom that is manually opened by pushing a plunger protruding from a front; the push inward plunger causing the liquid to be dispensed each time.

1 Claim, 4 Drawing Figures

HOUSEHOLD LIQUID DISPENSER

This invention relates generally to dispensing devices for liquid solutions. This application is a substitute application of Ser. No. 530,804, filed Dec. 9, 1974, now abandoned.

A principle object of the present invention is to provide a liquid dispenser for household liquid detergent that is quickly and easily operated by simply pushing a button on plunger on the case, so to accomplish the same with only one finger.

Still another object is to provide a household liquid dispenser that would be ideal to hang on a wall of a laundry room or kitchen where such detergent liquids are most likely to be used.

Further objects of the invention will appear as the description proceeds.

To the accomplishment of the above and related objects, this invention may be embodied in the form illustrated in the accompanying drawing, attention being called to the fact, however, that the drawings are illustrative only, and that changes may be made in the specific construction illustrated and described within the scope of the appended claims.

Figure 1:
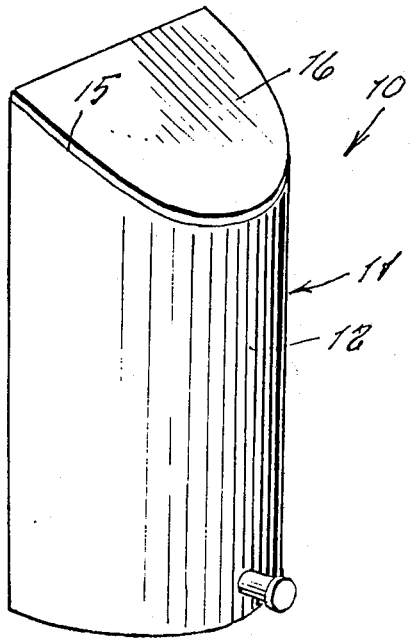
FIG. 1 is a perspective view.
Figure 2:
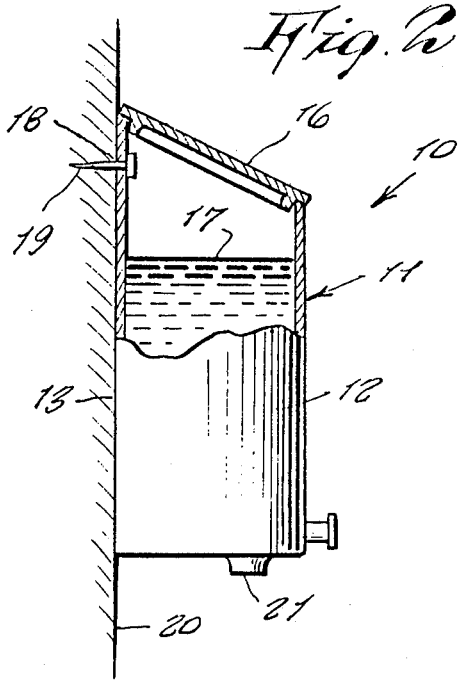
FIG. 2 is a side view partly in cross section.
Figure 3:
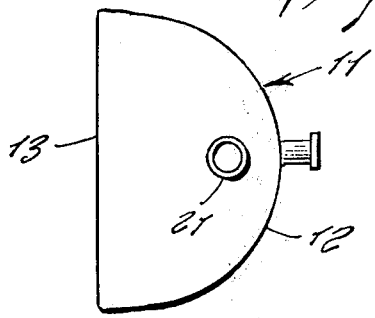
FIG. 3 is a bottom view.

Referring now to the drawing in detail, the reference numeral 10 represents a household liquid dispenser according to the present invention wherein there is a generally semi-cylindrical container 11 having a rounded front wall 12, flat rear wall 13 and bottom wall 14. A top edge 15 of the front wall is angularly upward toward the upper edge of the rear wall, and is fitted with a removable cover or lid 16, so that detergent liquid 17 may be placed inside the container. An opening 18 near an upper end of the rear wall receives a nail or screw 19 in order that the device may be hung from a vertical wall 20 of a room. A dispensing valve is in a bottom of the container.

A spout 21 projecting downward from an underside of the bottom wall 14 for dispensing the liquid communicates with a tubular front chamber 22 formed by horizontal partition 23. A first vertical partition **25*a* at the rear of chamber 22 forms a middle chamber 24, and rear of that a second vertical partition 25*b* forms a rear chamber 26**.

A horizontal plunger 27 extends into all three chambers by means of openings 28 and 29 in the vertical partitions, and a forward end of the plunger projects out of a front side opening 30 of the container so that it should be pushed by a person's finger 31 against a compression coil spring 32 located within the rear chamber. The horizontal partition 23 has a dispensing opening **23*a* therethrough the communicates with the middle chamber. The plunger has a general Z shape passage 33 therethrough which includes a long axially central portion 33*a* which at one end communicates with a vertical upward portion 33*b* for communicating with middle chamber 24; and the other end of the portion 33*a* communicates with a vertical downward portion 33*c* that communicates with the front chamber 22 and the spout 21**.

When the device is not in use, the relaxed compression coil spring pushes the plunger to its extreme forward position until a rear flange 34 of the plunger abuts against the second vertical partition **25*b* at which time, the passage portion 33*b* is pushed into the front chamber 22 so that liquid from middle chamber 24 cannot enter it. Likewise, portion 33*c*** does not align with the spout.

Figure 4:
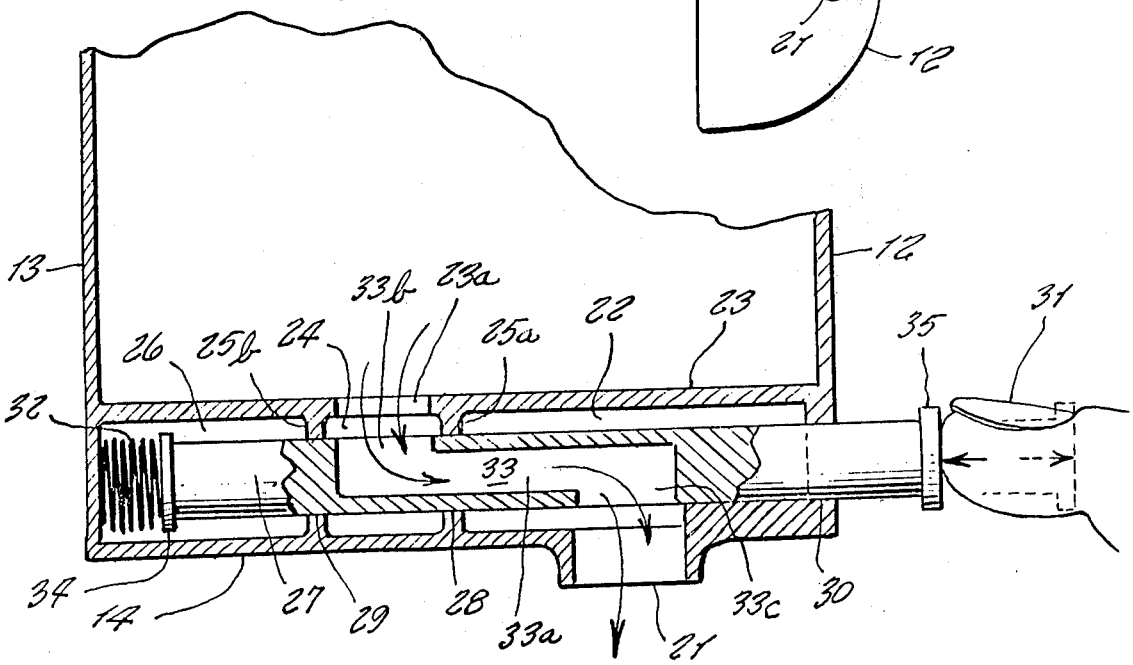
FIG. 4 is an enlarged side cross section showing the dispensing mechanism.

However, in operative use, when the operator wishes to dispense liquid detergent, the forward flange 35 of the plunger is pushed in until spring 32 is fully compressed, thus bringing passage portion **33*b* into communication with the middle chamber and the portion 33*c* into alignment with the spout, so that the fluid from the container thus can flow directly from the container out through the spout, as is shown in FIG. 4** of the drawing.

Thus, a household liquid dispenser is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A liquid dispenser for household use, comprising in combination, an upright, semi-cylindrical container having an opening at its upper end, a removable cover placed upon said container closing said opening, said opening communicating with a hollow interior within said container, a liquid placed through said opening into said interior said container comprising a flat rear wall and a rounded front wall integral at their lower ends with a horizontal bottom wall, an opening through said bottom wall, said opening communicating with a valve and said valve communicating with a downwardly dispensing spout, said valve comprising a housing integral with an underside of said bottom wall, said housing containing three chambers aligned along a horizontal row and separated by vertical partitions therebetween, a straight, horizontal plunger extending through openings in said partitions and into all three said chambers, a forward end of said plunger protruding through a forward opening through said front wall and outwardly thereof for manual operation, a rear opposite end of said plunger bearing against one end of a compression coil spring contained within a rear of said chambers, an opposite end of said coil spring bearing against an inner side of said rear wall, a middle of said chambers communicating with said opening through said bottom wall, and a forward of said chambers communicating with said spout, said plunger having a generally Z-shaped passage extending transversely therethrough, both ends of said passage being contained within said forward compartment when said coil spring has freely pushed said plunger into a forwardly position; and when said plunger is in rearwardly manually pushed position against a force of said compression coil spring then a rear one of said passage ends communicates with said middle chamber while a forward one of said passage ends communicates with said forward chamber, a rear end of said plunger having a diametrically enlarged flange that abutts with a rear side of said partition located between said rear and said partition located between said rear and said middle chambers when said plunger is in said forwardly pushed position, said flange stopping a forward travel of said plunger, and a distance along a longitudinal axis of said plunger between said passage ends being equal to a distance between said bottom wall opening and said spout.

* * * * *